US008485093B2

(12) United States Patent
Mathey et al.

(10) Patent No.: US 8,485,093 B2
(45) Date of Patent: Jul. 16, 2013

(54) CYLINDRICAL HEAT APPLICATION APPARATUS

(75) Inventors: Jesse S. Mathey, Perrysburg, OH (US); Stephen G. Mathey, Portage, OH (US)

(73) Assignee: The D.S. Brown Company, North Baltimore, OH (US)

( * ) Notice: Subject to any disclaimer, the term of this patent is extended or adjusted under 35 U.S.C. 154(b) by 395 days.

(21) Appl. No.: 12/831,812

(22) Filed: Jul. 7, 2010

(65) Prior Publication Data

US 2012/0006209 A1 Jan. 12, 2012

(51) Int. Cl.
*B30B 15/34* (2006.01)

(52) U.S. Cl.
USPC ..... 100/92

(58) Field of Classification Search
USPC ..... 100/92, 326; 165/80.1, 80.3, 162, 165/177
See application file for complete search history.

(56) References Cited

U.S. PATENT DOCUMENTS 3,054,710 A 9/1962 Nixon
4,168,192 A 9/1979 Nyberg
4,803,104 A 2/1989 Peigneur et al.
4,854,378 A * 8/1989 Zappia ..... 165/104.19
5,390,386 A 2/1995 Mathey et al.
5,765,634 A * 6/1998 Martins ..... 165/177

OTHER PUBLICATIONS

Hypalon Synthetic Rubber, Product Information General Guidelines for Wire and Cable Use, Brochure, Oct. 1991.

* cited by examiner

*Primary Examiner* — Jimmy T Nguyen
(74) *Attorney, Agent, or Firm* — David D. Murray

(57) ABSTRACT

A heat application apparatus includes a longitudinally split cylinder that may be disposed about a section of a suspension bridge cable or similar tubular article. The cylinder is split into two essentially identical semi-cylindrical halves which are pivotally connected by an elongate hinge. A plurality of toggle clamps are arranged transversely across the opens ends of the halves and may be engaged to positively connect and lock the edges together. On each of the inner faces of the halves is secured a semi-cylindrical air bladder. The bladders are covered by a flexible heat blanket having a uniformly distributed electrical resistance heating element. Independent air pressure regulators which are supplied with compressed air provide air at low pressure to the bladders and a suitable electrical connector all reside on the exterior of the apparatus. Optionally, an air compressor may be mounted on each half to supply each regulator and bladder independently, thereby configuring the apparatus so that it requires only electrical power to operate.

20 Claims, 6 Drawing Sheets

CYLINDRICAL HEAT APPLICATION APPARATUS

FIELD

The present disclosure relates to a cylindrical heat applying device and more particularly to a cylindrical heat applying device for applying pressure and heating protective coverings on suspension bridge cables and the like.

BACKGROUND

The statements in this section merely provide background information related to the present disclosure and may or may not constitute prior art.

The cables of suspension bridges and cable stayed bridges as well as similar lengthy tubular metal articles utilized outdoors are frequently subjected to severe environmental and climatic conditions. Even if conditions are relatively mild, the initial investment and the expected, extended service life demand that all practical efforts be undertaken to maintain the structure. Typically, therefore, such cables and articles are painted or otherwise coated to minimize rusting or other deterioration from such exposure. Although protected with suitable weather resistant paint or other coatings, periodic repainting or recoating of such cables and articles is invariably necessary. Such activity is costly and time consuming because of the relative inaccessibility of such cables. The cost and time involved are further increased because proper maintenance practice generally dictates removal of the previous paint or coating. Such removal typically raises environmental issues.

An alternative to such repeated repainting or recoating involves permanent application of a spiral or helical wrap of a Neoprene or similar polychloroprene band or strip about the cable or article. This approach to cable protection was not without drawbacks, however. First of all, the Neoprene could not be colored and thus, after application, if it was desired that the cable covering match the rest of the structure, it would still require painting. Second of all, it was necessary to seal adjacent layers of the wrap to one another with a solvent. This again was a labor intensive undertaking.

An improvement to this approach comprehends the application of a spiral wrap of Hypalon® to the cable or article. Hypalon is a registered trademark of the E.I. DuPont de Nemours Company for its brand of chlorosulfonated polyethylene. This material can be sealed to itself with the application of sufficient heat and thus eliminates the above-noted solvent sealing step. The use of a heat sealed spiral wrap of a band or strip of Hypalon® is described in detail in co-owned U.S. Pat. No. 5,390,386. Study of the subject patent reveals that proper sealing of the adjacent wraps or layers of Hypalon® is dependent upon sufficient and uniform application of heat to the exterior of the wrapped cable.

Because the various strands and cables that constitute the suspension cable do not assemble and nest uniformly, the outer surface of the suspension cable is irregular. Such an irregular surface, of course, is generally duplicated by the spiral wrapped band or strip, rendering uniform heat application difficult: protruding regions are in intimate contact with a heating device and may receive excessive heat while recessed regions may not contact the heating device and thus receive little heat. The present invention is directed to ensuring the sufficient and uniform application of heat to the exterior of the wrapped cable to provide the optimum protection to the cable and therefore its longest life with reduced maintenance expense.

SUMMARY

The present invention provides a heat application apparatus in the form of a split cylinder or clamshell that may be disposed about a section of a suspension bridge cable or similar tubular article. The cylinder is split lengthwise into two essentially identical semi-cylindrical halves which are pivotally connected by an elongate hinge. A plurality of toggle clamps are arranged transversely across the opens ends of the halves and may be engaged to positively connect and lock the edges together. On each of the inner faces of the halves is secured a semi-cylindrical air bladder. The bladders are covered by a flexible heat blanket having an electrical resistance heating element uniformly distributed over its area. Independent air pressure regulators which provide compressed air at low pressure to the bladders and a suitable electrical connector all reside on the exterior of the apparatus. Optionally, an air compressor may be mounted on each half to supply each air bladder independently, thereby configuring the apparatus so that it requires only electrical power to operate.

In operation, the apparatus is connected to suitable sources of electricity and compressed air, or only electrical power if the optional air compressors are utilized. The toggles are unlatched and released and the halves are opened, placed about a cable or other article, closed and the toggles relatched. The air bladders are then filled with compressed air to a pressure of between about 1 p.s.i. and 10 p.s.i. and the heater is activated for a prescribed time to heat and seal the wrapped layers of the cable or other article.

Thus it is an aspect of the present invention to provide a heat application apparatus for suspension bridge cables and similar tubular articles.

It is a further aspect of the present invention to provide a heat application apparatus having a cylindrical body that is split into two semi-cylindrical halves.

It is a still further aspect of the present invention to provide a heat application apparatus having a cylindrical body that is split into two semi-cylindrical halves which are pivotally joined by an elongate hinge.

It is a still further aspect of the present invention to provide a heat application apparatus having a cylindrical body that is split into two semi-cylindrical halves which may be releasably closed by toggle clamps.

It is a still further aspect of the present invention to provide a heat application apparatus having two semi-cylindrical halves each including an air bladder.

It is a still further aspect of the present invention to provide a heat application apparatus having two semi-cylindrical halves each including a electrical heating blanket.

It is a still further aspect of the present invention to provide a heat application apparatus having two-semi-cylindrical halves each having an independent air supply.

Further aspects, advantages and areas of applicability will become apparent from the description provided herein. It should be understood that the description and specific examples are intended for purposes of illustration only and are not intended to limit the scope of the present disclosure, invention or claims.

DRAWINGS

The drawings described herein are for illustration purposes only and are not intended to limit the scope of the present disclosure, invention or claims in any way.

DETAILED DESCRIPTION

The following description is merely exemplary in nature and is not intended to limit the present disclosure, invention, claims, or use.

Figure 1:
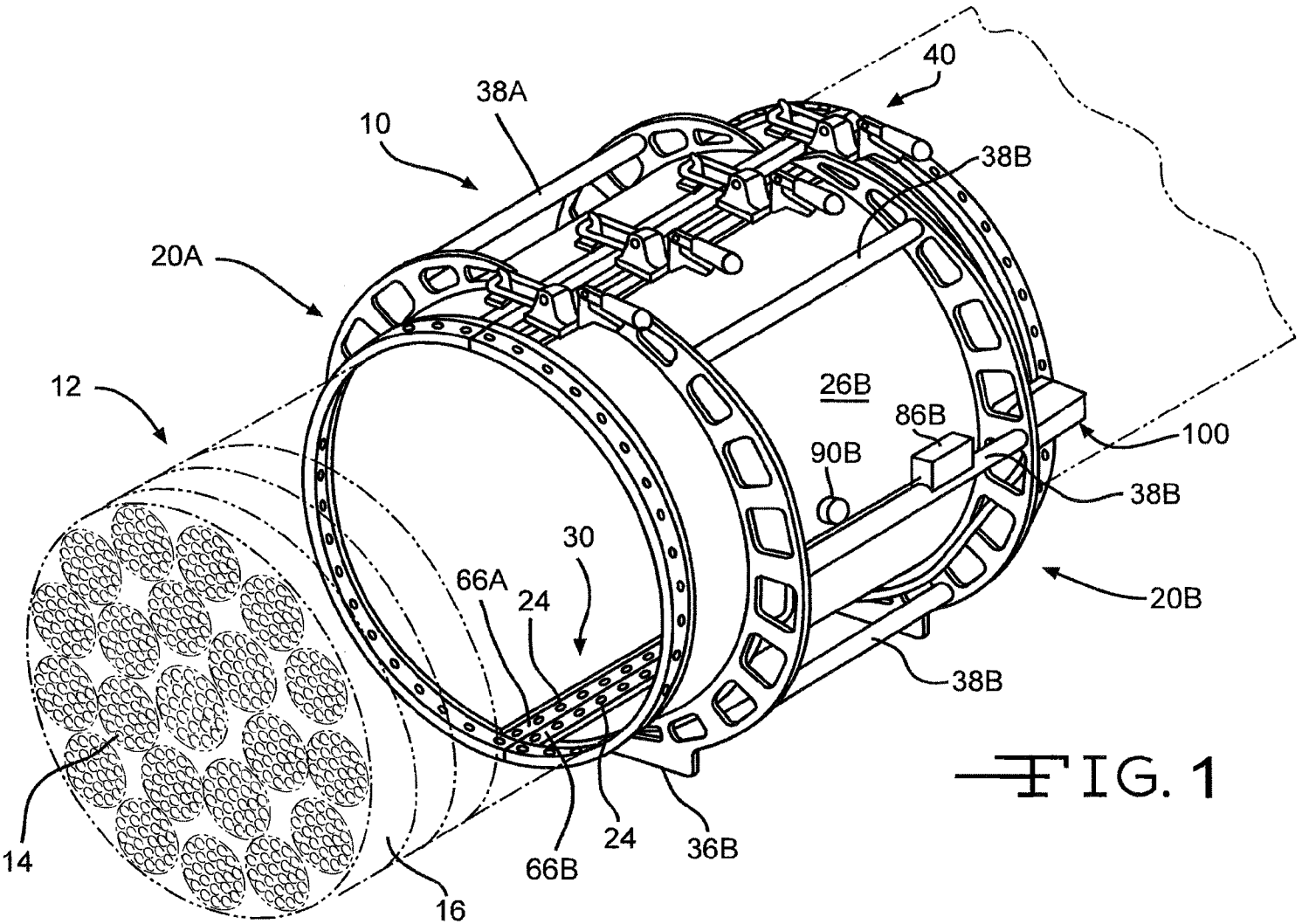
FIG. 1 is perspective view of a cylindrical heat application apparatus according to the present invention in place on a suspension bridge cable shown in phantom lines.
Figure 2:
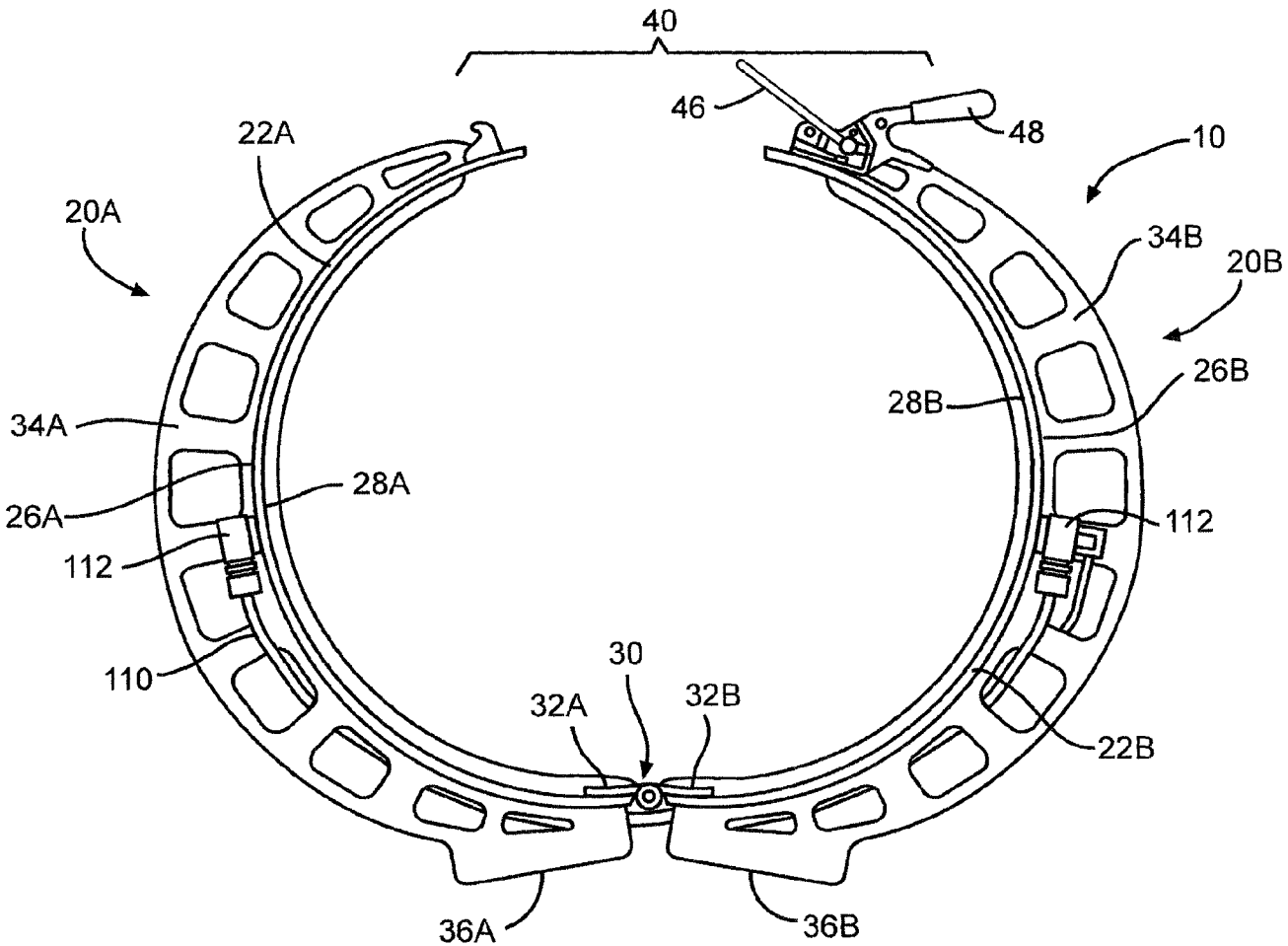
FIG. 2 is an end elevational view of a cylindrical heat application apparatus according to the present invention in an open position.

With reference to FIGS. 1 and 2, a cylindrical heat application apparatus for use with cables on conventional suspension bridges, cable stayed bridges and other tubular or cylindrical articles or components of indefinite length is illustrated and designated by the reference number 10. The heat application apparatus 10 is shown in place in a suspension bridge cable 12 having a core 14 of a plurality of wound strands, ropes and cables that is spirally or helically wrapped by a strip or band 16 of a heat sealable, thermoplastic material such as Hypalon®, as described in U.S. Pat. No. 5,390,386.

The heat application apparatus 10 is essentially a longitudinally split hollow cylinder or tube of a convenient length, typically between two and four feet (0.617 to 1.23 meters). The diameter, in turn, is dependent upon the outside diameter of the cable 12 or other article upon which the heat application apparatus 10 will be utilized. Typically, the nominal inside diameter of the apparatus 10 will be approximately one to three inches (25 to 76 millimeters) larger than the cable 12 or other article with which it will be utilized. Thus, it should be appreciated that the nominal diameter of the apparatus 10 may be as small as one foot (0.308 meters) or less to as large as four feet (1.23 meters) or more.

The heat application apparatus 10 comprises a first or left semi-cylindrical half or portion 20A and a second or right semi-cylindrical half or portion 20B pivotally secured together along adjacent longitudinal edges by a preferably full length, piano style hinge 30 having a first flange 32A attached to the first or left semi-cylindrical half or portion 20A and a second flange 32B attached to the second or right semi-cylindrical half or portion 20B as will be more fully described below. Alternatively, a plurality of separate, longitudinally spaced-apart hinges may be employed to pivotally connect the first and second halves or portions 20A and 20B. In most respects, the first cylindrical portion 20A and the second cylindrical portion 20B are symmetrical, mirror images of one another. Thus, only the first or left semi-cylindrical half or portion 20A will be fully described, it being understood that such full description applies equally to the second or right semi-cylindrical half or portion 20B and that any differences between them are also described.

The first semi-cylindrical half 20A includes a first rigid semi-cylindrical body panel 22A which is attached to the first flange 32A of the hinge 30 by suitable fasteners 24 such as rivets, machine bolts and nuts, self-threading screws and the like. Depending upon the materials from which the first body panel 22A and the first hinge flange 32A are constructed and other design and construction considerations, more permanent attachment means such as welding may also be utilized.

The first rigid semi-cylindrical body panel 22A includes a curved outside surface 26A and a curved inside surface 28A. Disposed on the outside surface 26A of the first body panel 22A are a pair of spaced apart semi-circular braces or reinforcements 34A. The braces 34A each include a flat, lower portion 36A adjacent the hinge 30 which serve as feet to maintain the apparatus 10 in an upright and non-rolling disposition for transport and when not in use. The braces 34A are preferably secured by welding to the outside surface 26A of the first body panel 22A. The braces or reinforcements 34A are intended to maintain the integrity and the circularity of the apparatus 10 against the hoop stress generated when it is in use. Accordingly, although the apparatus 10 illustrated in FIG. 1 utilizes two of the braces 34A, as the diameter of the apparatus 10 increases, additional braces 34A may be both desirable and utilized. In addition to preventing longitudinal warpage of the apparatus 10, the braces or reinforcements 34A also function as handles which an operator can grip to maneuver the apparatus 10. Extending longitudinally between the braces or reinforcements 34A are a plurality of stabilizing beams or rods 38A. Once again, while three of the stabilizing beams or rods 38A are illustrated, more may be utilized as the size of the apparatus 10 increases.

Figure 3:
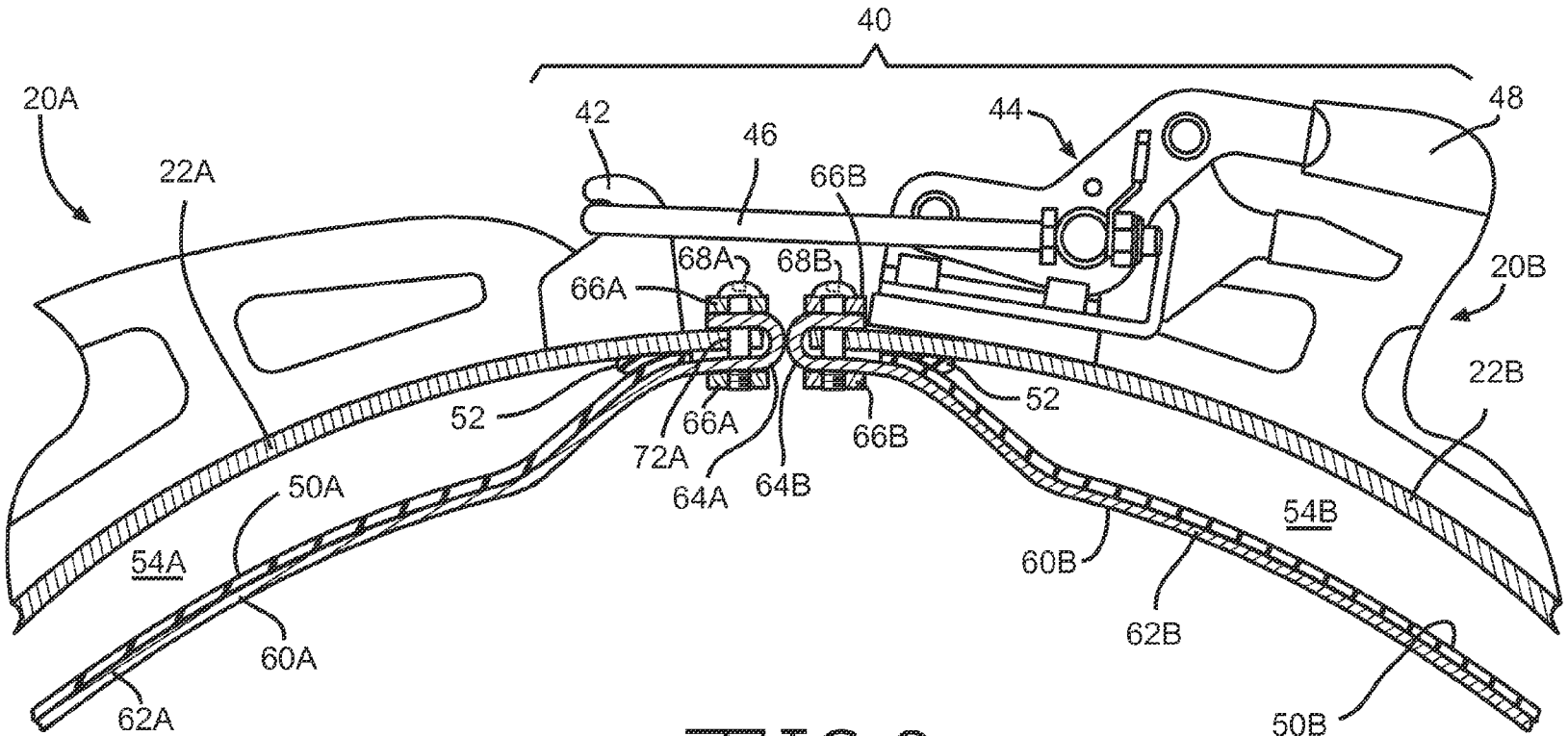
FIG. 3 is an enlarged, fragmentary end view of a cylindrical heat application apparatus according to the present invention showing the mounting of the air bladder and heat blanket with the toggles in the locked position.

Referring now to FIGS. 1, 2 and 3, at the top of the apparatus 10, opposite the hinge 30 are a plurality of toggle clamp assemblies 40. On one side, for example, on the first or left semi-cylindrical half or portion 20A are a plurality of hooks 42 arranged in a line parallel to the adjacent edge of the first semi-cylindrical body panel 22A. On the other side, for example, the second or right semi-cylindrical half or portion 20B are a like plurality of complementary toggle clamps 44 also arranged in a line along the adjacent edge of the second semi-cylindrical body panel 22B. Each of the toggle clamps 44 includes a U-shaped strap 46 secured to an over-center pivoted handle 48. To close and secure the two halves or portions 20A and 20B together, they are moved into the position illustrated in FIG. 3, the straps 46 are placed over the hooks 42 and the handles 48 are moved from the position illustrated in FIG. 2 to the position illustrated in FIG. 3.

Figures 4, 4A, 5, 5A:
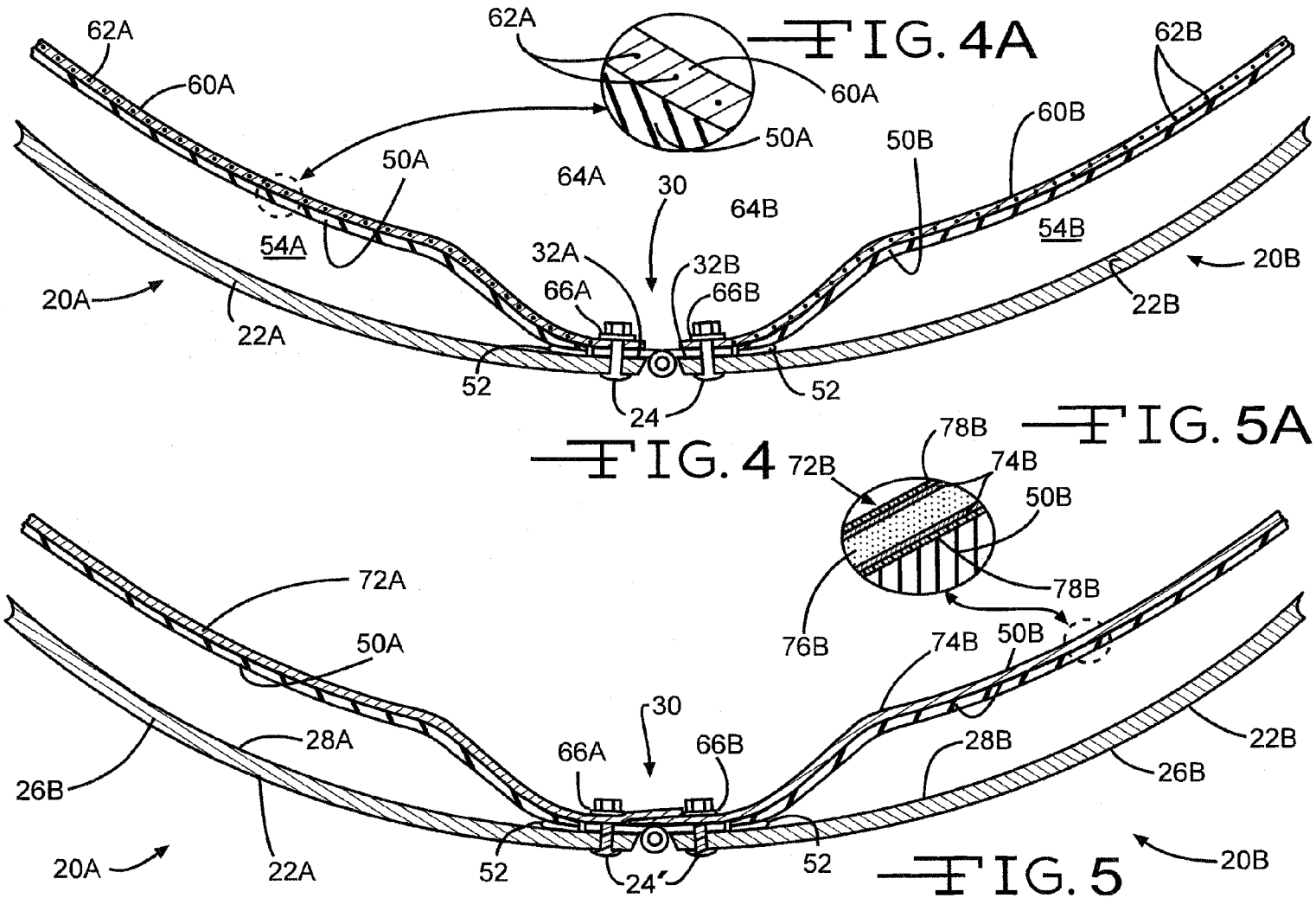
FIG. 4 is an enlarged, fragmentary end view of the hinge of a cylindrical heat application apparatus according to the present invention showing the mounting of the air bladder and heating blanket.
FIG. 4A is a greatly enlarged, fragmentary, sectional view of a first embodiment of a heating blanket utilized in the present invention.
FIG. 5 is an enlarged, fragmentary end view of an alternate embodiment of the heating blanket of the apparatus according to the present invention showing the mounting of the air bladder and heating blanket.
FIG. 5A is a greatly enlarged, fragmentary, sectional view of a second embodiment of a heating blanket utilized in the present invention.

Referring now to FIGS. 3, 4 and 4A, on the inside surface 28A of the first body panel 22A is a flexible air bladder panel 50A. The air bladder panel 50A is sealingly secured along the edges of the inside surface 28A of the first body panel 22A by a silicone adhesive 52 or similar material that provides an air-tight seal and defines a first air chamber 54A with the first body panel 22A. Alternatively, aluminum strips over the edges of the air bladder panel 50A with fasteners may be utilized as a holddown. Extending over the surface of the air bladder panel 50A is a first flexible heating blanket 60A. The first heating blanket 60A is preferably fabricated of a heat resistant flexible material such as silicone rubber and includes an embedded electrical resistance heating element 62A. The heating element 62A is preferably arranged in a zig-zag pattern in parallel strips or bands having a width of from two to three inches (51 to 76 millimeters). The first heating element 62A is preferably designed to generate and dissipate between about 2 and 7 watts per square inch.

The first heating blanket 60A also includes a peripheral region 64A which lacks the heating element 62A and which is wrapped around three edges of the first body panel 22A and secured there by elongate retaining plates or strips 66A and a plurality of suitable fasteners 68A or other attachment means which extend through suitable openings in the strips 66A, the first body panel 22A and two layers of the first heating blanket 60A. The inner retaining plate or strip 66A may either include threaded openings complementary to the fasteners 68A or may be unthreaded and thus require nuts (not illustrated).

It will be appreciated that the hinge 30 including the first flange 32A and the second flange 32B pivotally connects the first body panel 22A to the second body panel 22B. The edges of the air bladder panels 50A and 50B are secured to the inside surfaces 28A and 28B of the body panels 22A and 22B by the silicone adhesive 52 or similar material adjacent the hinge 30. The longitudinal edges of the heating blankets 60A and 60B, including the regions 64A and 64B without the heating elements 62A and 62B are secured to the respective edges of the first body panel 22A and the second body panel 22B with additional elongate plates or strips 66A and 66B and the plurality of suitable fasteners 24.

Referring now to FIGS. 5 and 5A, an alternate embodiment of the heating blanket which improves uniformity of heat application is illustrated. The embodiment is the same with regard to the body panels 22A and 22B, the hinge 30, the toggle assemblies 40, the bladder panels 50A and 50B and the elongate plates or strips 66A and 66B along the hinge 30. Each of the heating blankets 72A and 72B includes a pair of flexible, spaced-apart panels or electrodes 74 which are coextensive with and are in intimate electrical contact with an inner resistive layer or element 76. A thin, preferably electrically insulating outer protective layer or skin 78 may be formed on or disposed over the outside surfaces of the panels or electrodes 74. The heating blankets 72A and 72B provide exceedingly uniform heat and heat application. More importantly, the heating blankets 72A and 72B provide heat along their edges or extremities and holes or perforations may be cut or formed in the blankets 72A and 72B at any location so long as the panels or electrodes 74 remain separated, i.e., not in electrical contact.

To ensure this, the fasteners 24' are fabricated of nylon or other rugged, electrically insulating material. It will thus be appreciated that, as illustrated in FIG. 5, the edges of the heating blankets 72A and 72B may be overlapped slightly to ensure more uniform and improved heat application. It should be understood, however, that the heating blankets 72A and 72B are not wrapped around the edges of the first and second semi-cylindrical halves or portions 20A and 20B. Rather, they are attached along the edges of the hinge 30 and the rest of the heating blankets 72A and 72B float and the remaining edges hang free as this type of heating element cannot be wrapped around an edge as the panels or electrodes 74 are thin but relatively rigid structures.

Figure 6:
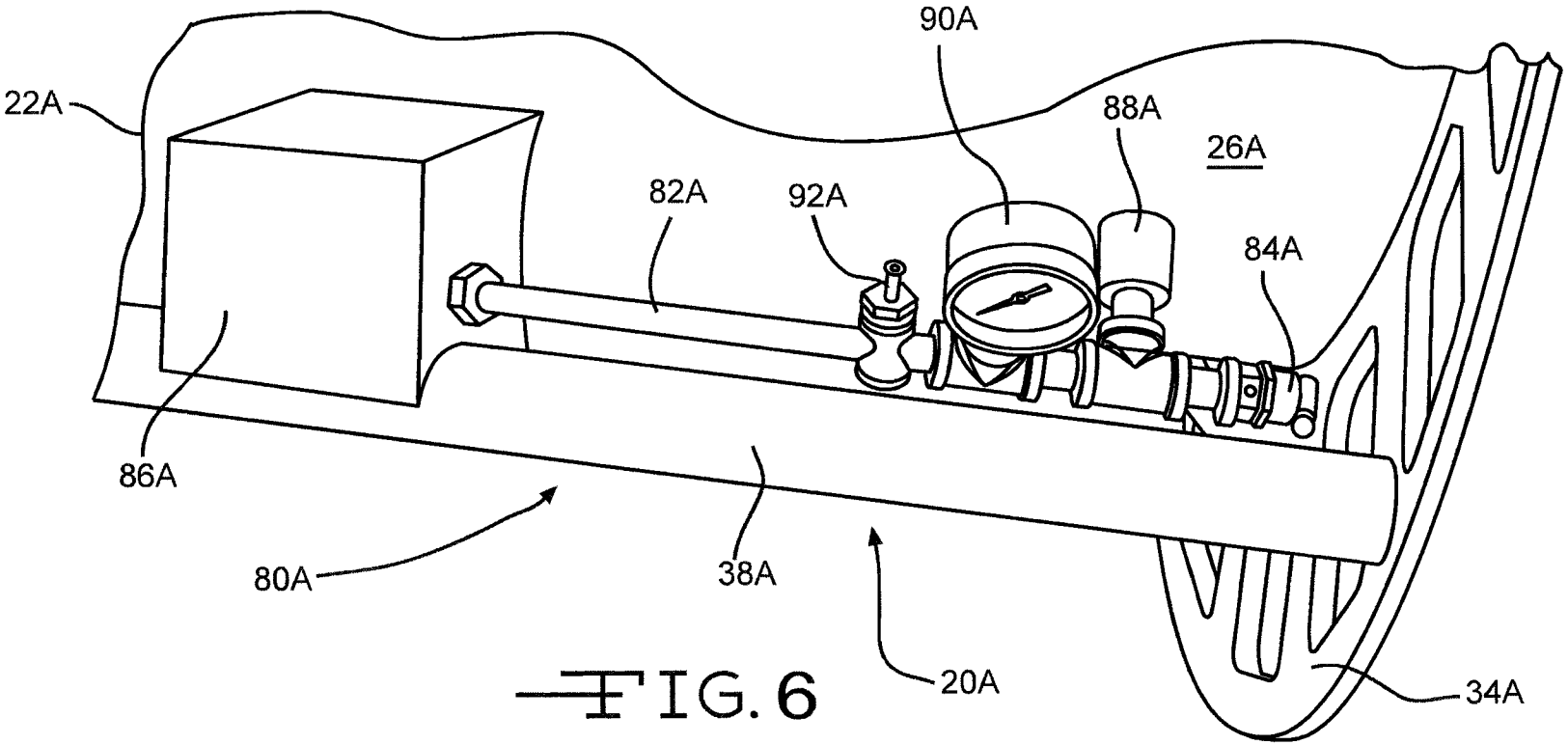
FIG. 6 is a fragmentary perspective view of a cylindrical heat application apparatus according to the present invention showing the air supply components.

Referring now to FIG. 6, each of the first and second semi-cylindrical halves or portions 20A and 20B of the apparatus 10 also includes an independent air supply assembly 80A and 80B. The first air supply assembly 80A includes a first manifold 82A having a quick release connector 84A at one end. The quick release connector 84A may be coupled to a hose having a complementary connector which is in communication with a source of compressed air (all not illustrated). Additionally and optionally, if it is desired that the apparatus 10 require only electrical power in order to operate, a first small electrically powered air compressor 86A may be mounted to the exterior surface 26A of the first body panel 22A with its output provided to the first manifold 82A. The first manifold 82A communicates with the first air chamber 54A through a suitable fitting 88A. Also in fluid communication with the first manifold 82A is a first pressure gauge 90A. The first pressure gauge 90A preferably has a range of approximately zero to fifteen or twenty p.s.i. Also in fluid communication with the manifold 82A is a manually activated pressure release valve 92A. The pressure release valve 92A is activated to reduce air pressure or release air within the first air chamber 54A at the end of a heating cycle or at other times.

Referring to FIGS. 1, 2, 3 and 4, the second or right semi-cylindrical half or portion 20B is, as noted above, essentially a mirror image of the first or left semi-cylindrical half or portion 20A. Thus, it includes an outside surface 26B having a plurality of braces 34B including the flat lower portions 36B, a plurality of stabilizing rods 38B, an inside surface 28B, a portion of the toggle clamp assemblies 40, an air bladder panel 50B defining a second air chamber 54B, a heating blanket 60B having an electrical resistance heating element 62B as well as retaining plates 66B and suitable fasteners 68B. It also includes the second air supply assembly 80B having a second manifold 82B, a second quick release connector 84B, an optional second air compressor 86B, a second fitting 88B, a second pressure gauge 90B and a second pressure relief valve 92B.

Figure 7:
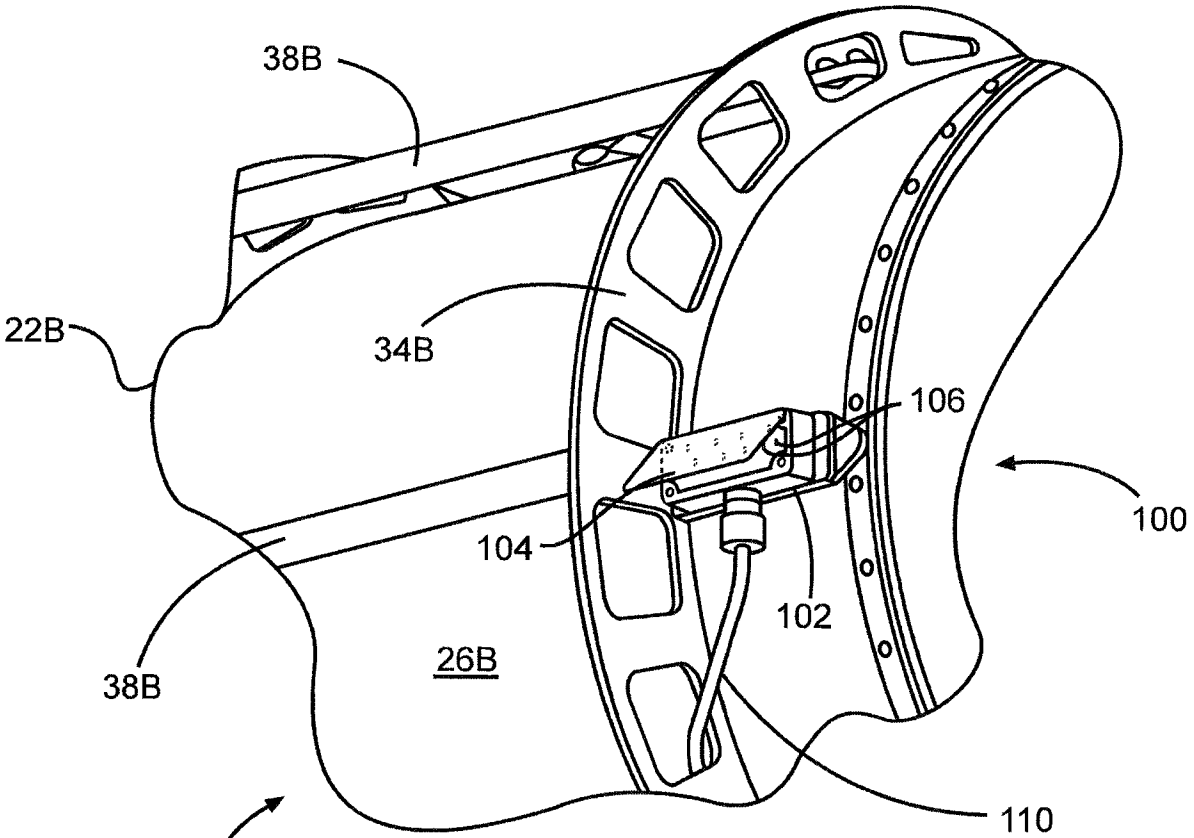
FIG. 7 is a fragmentary perspective view of a cylindrical heat application apparatus according to the present invention showing the electrical input connector.

Referring now to FIG. 7, the apparatus 10 includes a single electrical connector assembly 100 which may be secured to the outside surface 26B of the second body panel 22B at any convenient location. The electrical connector assembly 100 includes a housing 102 having a pivoting and locking cover 104 which protects a plurality of electrical terminals 106 which are connected to various conductors in a cable 110. The cable 110 terminates at one or more junctions or feedthroughs 112 where the conductors are connected to the wires of the heating elements 62A and 62B or to the electrodes 74. The conductors in the cable 110 provide electrical energy to the heating blankets 60A and 60B (or 72A and 72B) and the compressors 86A and 86B, if the heat application apparatus 10 is so equipped.

In operation, the heat application apparatus 10 is opened wider than the position illustrated in FIG. 2 and placed about a portion of a suspension bridge cable 12 or other cylindrical article. The halves 20A and 20B are then closed about the cable 12 or other article and the toggle clamp assemblies 40 engaged and locked. Next, the individual air bladders 54A and 54B are filled to an appropriate pressure, preferably between approximately one and five p.s.i. Finally, electrical energy is applied to the heating elements 62A and 62B (or 72A and 72B) and sufficient heat is applied to the strip or band 16 of cable wrap to cure and/or seal the layers together. The air is then released from the air bladders 54A and 54B through the pressure relief valves 92A and 92B, the toggle clamp assemblies 40 are released, the apparatus 10 opened and repositioned on the cable 12 or other article. These steps are repeated until the heating and curing or sealing is completed along the length of the cable 12 or other article.

The description of the invention is merely exemplary in nature and variations that do not depart from the gist of the invention are intended to be within the scope of the invention.

Such variations are not to be regarded as a departure from the spirit and scope of the invention.

What is claimed is:

1. A heat application apparatus comprising, in combination, a cylindrical body including a first cylindrical half and a second cylindrical half;

means for pivotally connecting said first cylindrical half to said second cylindrical half;

at least a pair of releasable clamp assemblies disposed on said first and second halves for maintaining said halves in a cylindrical configuration;

a layer of a flexible, air impermeable material sealingly secured to an inside surface of each of said first and said second cylindrical halves; and a flexible heating blanket disposed over said material.

2. The heat application apparatus of claim 1 further including an air compressor for providing compressed air to a space between said inside surface and said material of each of said cylindrical halves.

3. The heat application apparatus of claim 1 further including a pair of semi-circular braces secured to an outside surface of each of said halves.

4. The heat application apparatus of claim 1 wherein said layer of material is secured to said inside surface of each of said halves by an adhesive.

5. The heat application apparatus of claim 1 wherein said clamp assemblies each include a hook portion secured to one of said halves and a toggle portion secured to another of said halves.

6. The heat application apparatus of claim 1 further including an air pressure gauge and an air pressure regulator.

7. The heat application apparatus of claim 1 further including an electrical connector disposed on an outside surface of one of said halves.

8. A heat application apparatus for cables and the like comprising, in combination, a cylindrical body having a first semi-cylindrical portion and a second semi-cylindrical portion, each of said portions having first and second parallel edges and an inner surface;

hinge means disposed between and pivotally interconnecting said first edges of said first and second portions;

means disposed adjacent said second edges of said first and second portions for selectively maintaining said portions in a cylindrical shape;

a layer of flexible, air impermeable material secured to the inner surface of each of said portions and forming an air bladder; and a flexible heating blanket disposed over said material, said blanket including an electrical heating element.

9. The heat application apparatus of claim 8 further including an air compressor for providing compressed air to said air bladder.

10. The heat application apparatus of claim 9 further including an air pressure gauge and an air pressure regulator in fluid communication with said air compressor.

11. The heat application apparatus of claim 8 further including a pair of semi-circular braces secured to an outside surface of each of said portions.

12. The heat application apparatus of claim 11 further including a plurality of longitudinal braces extending between said semi-circular braces.

13. The heat application apparatus of claim 11 wherein said semicircular braces include flats which function as feet.

14. The heat application apparatus of claim 8 wherein said heating element extends over said hinge means.

15. A heat application apparatus for cables and the like comprising, in combination, a cylindrical body including a first semi-cylindrical half and a second semi-cylindrical half;

at least one hinge pivotally connecting said first semi-cylindrical half to said second semi-cylindrical half;

at least a pair of releasable clamp assemblies disposed on said first and second halves for selectively disposing said halves in a cylindrical shape;

a layer of a flexible, air impermeable material secured to an inside surface of each of said first and said second cylindrical halves to form first and second air bladders; and a flexible heating blanket disposed over said first and second air bladders.

16. The heat application apparatus of claim 15 wherein said flexible heating blankets include an electrical resistance heating element.

17. The heat application apparatus of claim 15 further including an air pressure regulator, a pressure release valve and a pressure gauge.

18. The heat application apparatus of claim 15 further including an air compressor, a pressure gauge and a pressure relief valve in fluid communication with each of said first and second air bladders.

19. The heat application apparatus of claim 15 further including a pair of semi-circular braces secured to an outside surface of each of said halves.

20. The heat application apparatus of claim 19 further including a plurality of longitudinal braces extending between said semi-circular braces.

* * * * *